United States Patent [19]

Fischer

[11] 4,002,156

[45] Jan. 11, 1977

[54] AIR GUN

[75] Inventor: Earl L. Fischer, Bentonville, Ark.

[73] Assignee: Victor Comptometer Corporation, Chicago, Ill.

[22] Filed: May 14, 1975

[21] Appl. No.: 577,203

[52] U.S. Cl. ..... 124/67; 124/82

[51] Int. Cl.[2] ..... F41B 11/00

[58] Field of Search ..... 124/11, 14, 15, 51, 124/67, 82

[56] References Cited

UNITED STATES PATENTS

| | | | |
|---|---|---|---|
| 1,205,586 | 11/1916 | Worley | 124/15 |
| 2,097,866 | 11/1937 | Tomlinson | 124/15 |
| 2,306,668 | 12/1942 | Stevens | 124/15 |
| 3,087,481 | 4/1963 | Foster | 124/11 R |
| 3,119,384 | 1/1964 | Merz | 124/11 R |
| 3,127,885 | 4/1964 | Kline et al. | 124/11 R |
| 3,207,143 | 9/1965 | Kline et al. | 124/11 R |
| 3,548,802 | 12/1970 | Green | 124/11 R |
| 3,680,540 | 8/1972 | Stengl | 124/11 R |
| 3,908,626 | 9/1975 | Hammond | 124/15 |
| 3,913,554 | 10/1975 | Pitcher | 124/15 |

*Primary Examiner*—Delbert B. Lowe
*Attorney, Agent, or Firm*—Bruce G. Klaas

[57] ABSTRACT

There is herein disclosed an air gun having a breech block assembly, including a plurality of mating molded plastic members defining a guideway for a pivotally mounted projectile transfer member, movable during cocking of the gun from a firing position holding a projectile in alignment with the gun barrel to a loading position to receive another projectile and back to the firing position, with sealing means being provided to effect sealing engagement between the projectile transfer member and the molded plastic members of the breech block assembly in the firing position whereat the projectile is transferred from the projectile transfer member to a firing chamber provided in one of the molded plastic members by air pressure at the beginning of a firing cycle and held in the firing chamber in sealing engagement therewithin during an intermediate portion of the firing cycle and then discharged from the firing chamber through the gun barrel upon application of predetermined high pressure air toward the end of the firing cycle.

27 Claims, 27 Drawing Figures

AIR GUN

BACKGROUND AND SUMMARY OF THE INVENTION

This invention relates generally to fluid operated guns for propelling a projectile by relatively high fluid pressure and, more particularly, to an air gun of the type having an air compression chamber in which a spring biased piston is operable to compress air to propel a B-B type projectile from the gun. while the inventive concepts are disclosed hereinafter with reference to such an air gun, it is to be understood that certain of the inventive concepts may be applicable to other types of fluid operated guns such as guns which are operated by a supply of compressed gas such as $CO_2$ contained in removable and replaceable storage cylinders. In addition, it is to be further understood that certain of the inventive concepts may be applicable to other types of projectiles such as pellets.

While many types of transfer systems have been proposed and utilized heretofore in connection with air and gas operated guns, the present invention provides a projectile transfer system which has the advantages of providing very reliable uniform operating characteristics with a minimum number of relatively inexpensive parts while providing automatic transfer of a projectile from a storage chamber to a firing position during a cocking cycle and obtaining very effective sealing of the moving parts of the transfer system in the firing position to maximize efficiency and to obtain relatively uniform high velocities of projectiles fired from the gun. In addition, the arrangement of the parts of the gun is such as to provide maximum safety in use of the gun by precluding accidental firing of a projectile until the gun has been completely prepared for a firing cycle.

The present invention provides a new and improved arrangement of a new and improved transfer member and a new and improved firing chamber member whereby a projectile is transferred from the transfer member to the firing chamber member by compressed air during an initial portion of the firing cycle and then held in the firing chamber during an intermediate portion of the firing cycle in sealed relationship to the firing chamber member until the terminal portion of the firing cycle when a predetermined high pressure condition has been attained in the firing chamber.

The present invention further provides a new and improved arrangement of a new and improved transfer member and new and improved block assembly members whereby an air passage from an air compression chamber to the barrel bore is sealed in a manner such that substantially all the energy of the compressed air is effective in propelling a projectile from the gun while requiring a minimum number of relatively inexpensive and easily assembled parts.

The present invention further provides a new and improved arrangement of a new and improved transfer member and new and improved projectile storage structure facilitating loading of a projectile in the transfer member and transfer of the projectile to a firing position without jamming of the gun while insuring the transfer of only one projectile at a time.

The present invention further provides a new and improved arrangement of a new and improved transfer member and a new and improved cocking mechanism of an air gun whereby the transfer member is positively activated between a loading position and a firing position during a cocking cycle.

The present invention further provides a new and improved arragement between the new and improved cocking mechanism and new and improved safety mechanisms to prevent accidental firing of the gun during a cocking cycle.

The present invention also provides various other more specific new and improved arrangements of new and improved gun structure which are hereinafter described in detail.

DESCRIPTION OF DRAWING

An illustrative and presently preferred embodiment of the invention is shown on the accompanying drawing in which.

DETAILED DESCRIPTION

Figure 1:
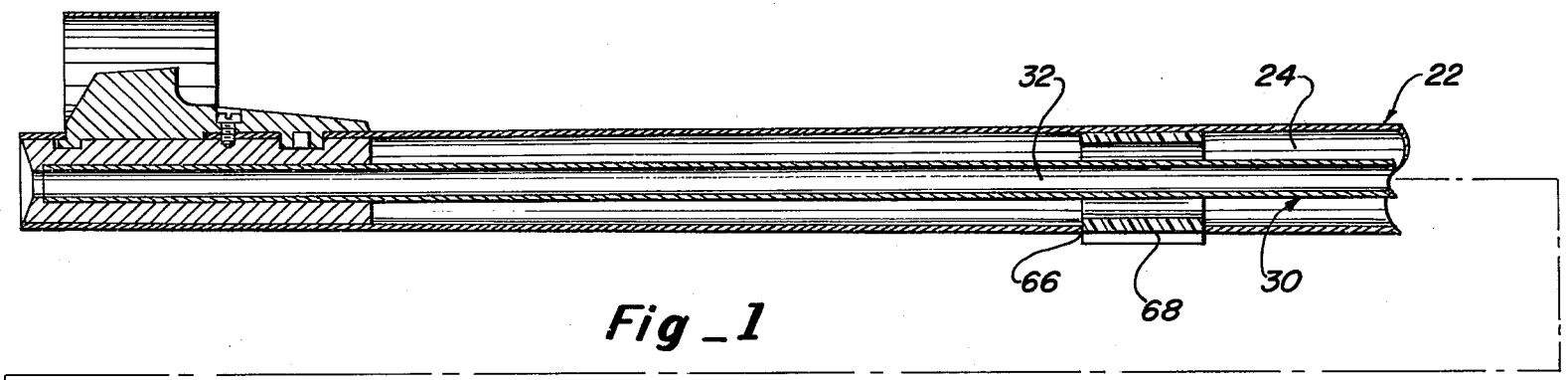
FIGS. 1, 1*a* and 1*b* are a side elevational view, in cross section, showing a gun embodying the inventive concepts.
Figure 1A:
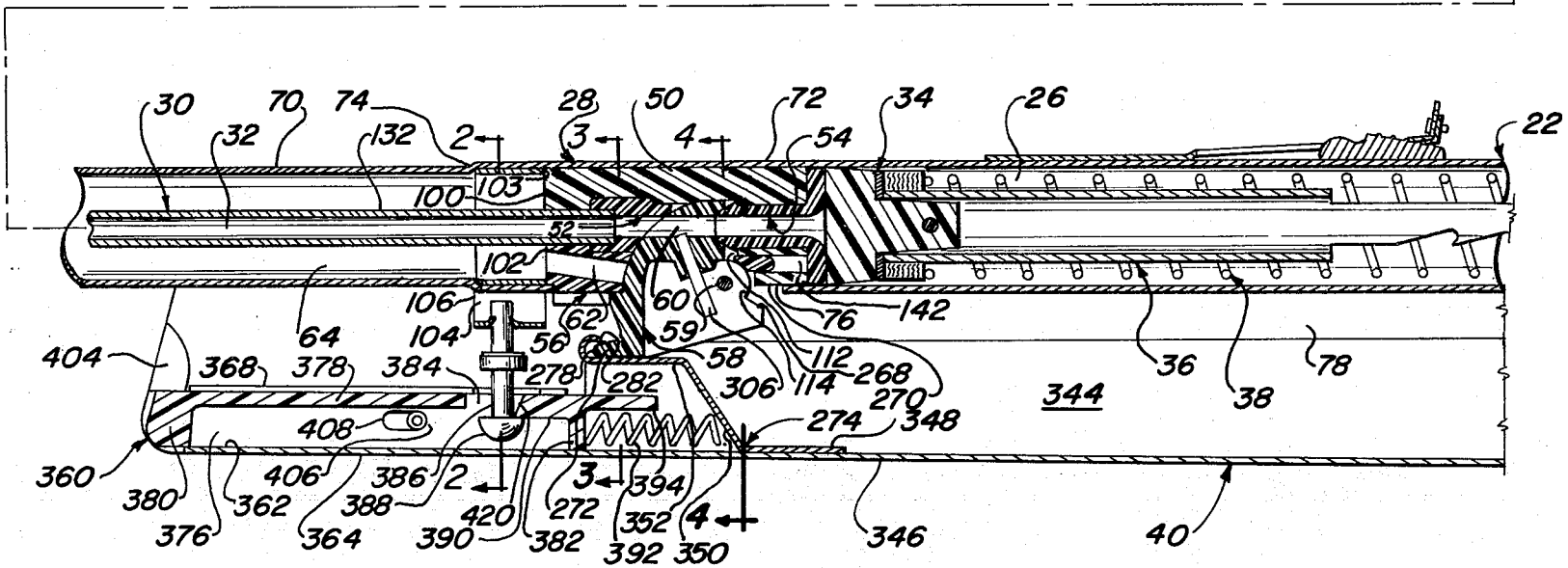

Referring now to FIGS. 1 and 1*a*, in general, the gun comprises a metallic receiver means 20, a tubular housing means 22 divided into a barrel and projectile storage chamber 24 and an air compression 26 by a breech block means assembly 28, barrel means 30 having a bore 32 through which a projectile such as a steel B-B is propelled from the gun by compressed air, a piston means assembly 34 mounted on piston rod means 36 and operable from a retracted cocked position to an extended fired position by a compression spring 38, a cocking lever means 40 pivotally mounted on a pivot pin 42 for pivotal movement between a retracted stowed firing position and a downwardly rearwardly pivotally extended cocking position to forcibly move the piston means assembly rearwardly to the cocked firing position by engagement of an actuating lever 44 with the rear end of the piston rod means 36; a pivotally mounted sear member 46 latchably engageable with the piston rod means to hold the piston means in the cocked firing position; and a pivotally mounted trigger assembly 47 by which the sear may be released to fire the gun.

In general, the breech assembly means comprises an elongated generally cylindrical main block member 50 mounted within the tubular housing means 22 between the rear end of the barrel means 30 and the air compression chamber 26. A firing chamber — connection member 52 is mounted in the member 50 at the rear end of the barrel means and a sealing sleeve member 54 is mounted in the rear end of member 50. An elongated lower support block member 56 is associated with the front and intermediate bottom portions of the member 50 and pivotally supports a transfer member 58 on a pivot pin 59. The transfer member 58 is pivotally movable between a firing position, shown in FIG. 1*a*, with an elongated cylindrical projectile holding chamber 60 in axial alignment with the barrel bore 32, and a downwardly displaced loading position (not shown) with chamber 60 aligned with the rearward lower end of a projectile feed bore 62 in member 56 connected at the forward upper end to a projectile storage chamber 64. A projectile loading opening 66 in the wall of housing 22 is covered by a molded plastic loading door 68 rotatably mounted on the inner peripheral surface of the housing.

Figure 1B:
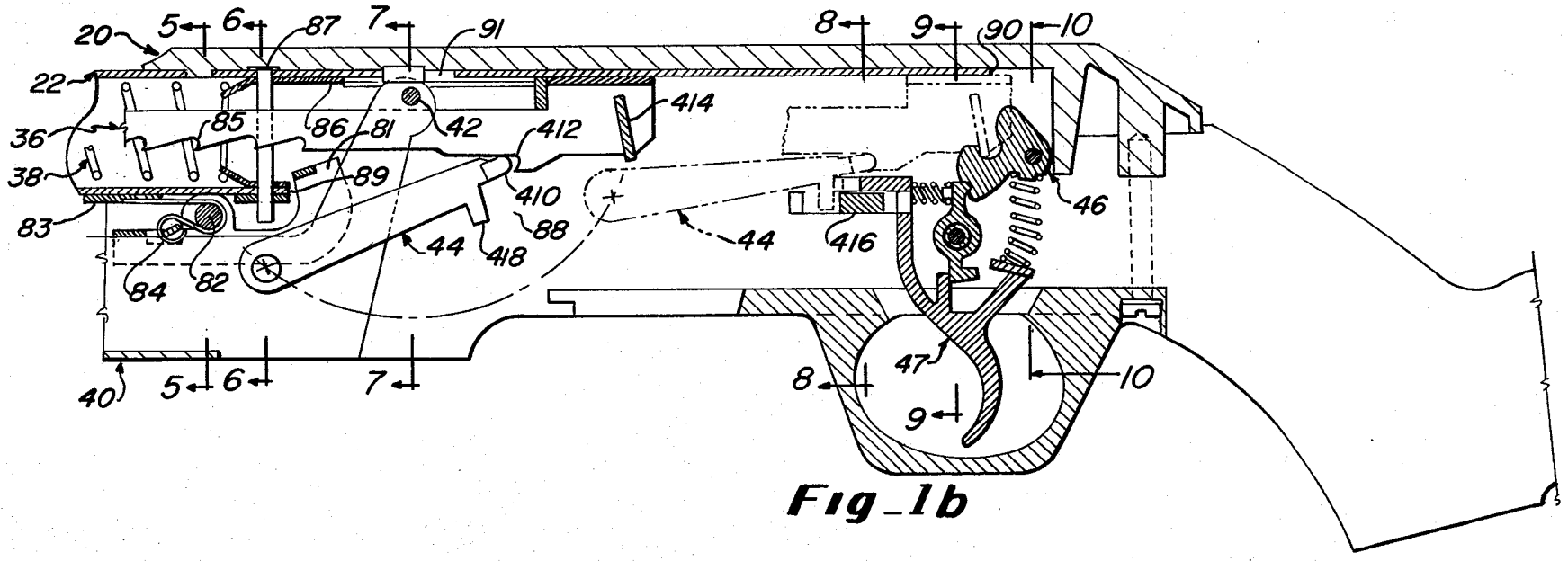
Figure 3:
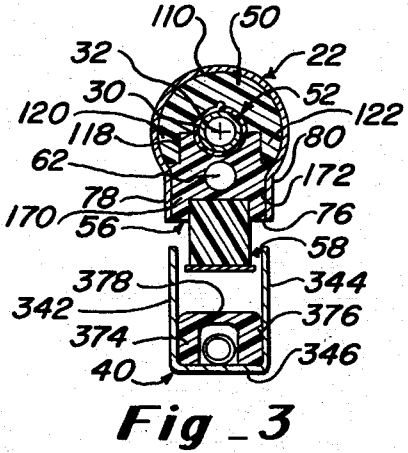
FIG. 3 is a cross-sectional view of the gun, with parts removed, taken along the line 3—3 in FIG. 1*a;*
Figure 5:
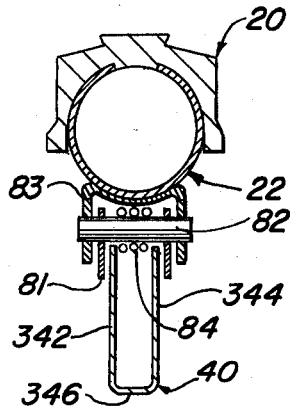
FIG. 5 is a cross-sectional view of the gun, both parts removed, taken along the line 5—5 in FIG. 1*b;*
Figure 6:
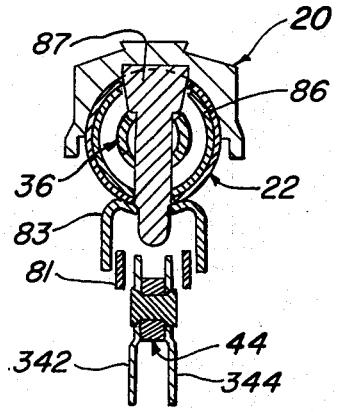
FIG. 6 is a cross-sectional view of the gun, with parts removed, taken along the line 6—6 in FIG. 1*b;*
Figure 7:
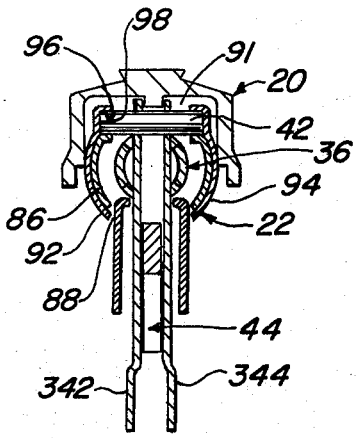
FIG. 7 is a cross-sectional view of the gun, with parts removed, taken along the line 7—7 in FIG. 1*b;*
Figure 8:
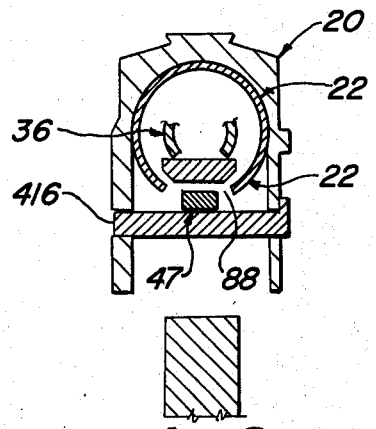
FIG.8 is a cross-sectional view of the gun, with parts removed, taken along the line 8—8 in FIG. 1*b;*
Figure 9:
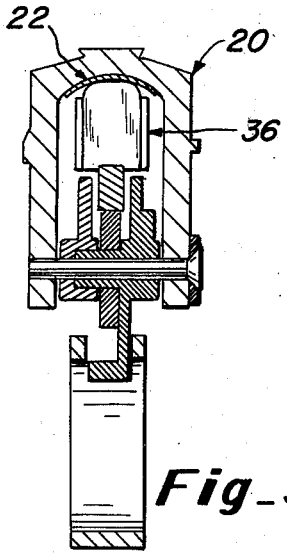
FIG. 9 is a cross-sectional view of the gun, with parts removed, taken along the line 9—9 in FIG. 1*b;*
Figure 10:
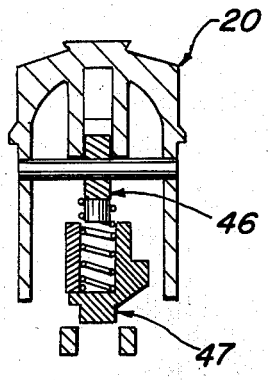
FIG. 10 is a cross-sectional view of the gun, with parts removed, taken along the line 10—10 in FIG. 1*b;*

The tubular housing 12 is made of sheet metal with a front portion 70 of slightly smaller diameter than a rear portion 72 and connected thereto by an annular abutment shoulder 74. An elongated generally rectangular downwardly facing slot 76 is provided in the bottom of the tubular housing between the shoulder 74 and the compression chamber 26 by downwardly extending flange portions 78, 80 as shown in FIG. 3. A safety lever 81 is pivotally mounted on a pin 82 mounted on a bracket member 83, FIGS. 1*b* and 5, with a spring 84 arranged to bias the lever 81 toward engagement with a series of notches 85 in the piston rod 36. The safety lever is arranged to prevent forward movement of the piston rod 36 during the cocking cycle and until the cocking lever is returned to the stowed position. An intermediate support tube 86 is fixedly mounted in the housing 22 to support pin 42, as shown in FIG. 7, and a pin 87 extends through housing 22, support tube 86, and bracket 83 as shown in FIG. 6. An elongated downwardly facing access slot 88 in the rear bottom of the tubular housing begins at 89 at the rear of the compression chamber 26 and extends to the rear end of the tubular housing at 90. An upwardly facing slot 91 in the top of the tubular housing, intermediate the compression chamber and the rear end of the housing, is defined by opposite flange portions 92, 94, FIG. 7, which are each formed to provide upper and side bearing surfaces 96, 98 for pin 42. The breech block assembly is fixedly mounted adjacent shoulder 74 and the front side surfaces 100, 102 of members 50, 56 FIG. 1a, abut the rear side surface 103 of a fixed metallic collar 104, the front surface 106 of which abuts the shoulder 74.

Figure 15:
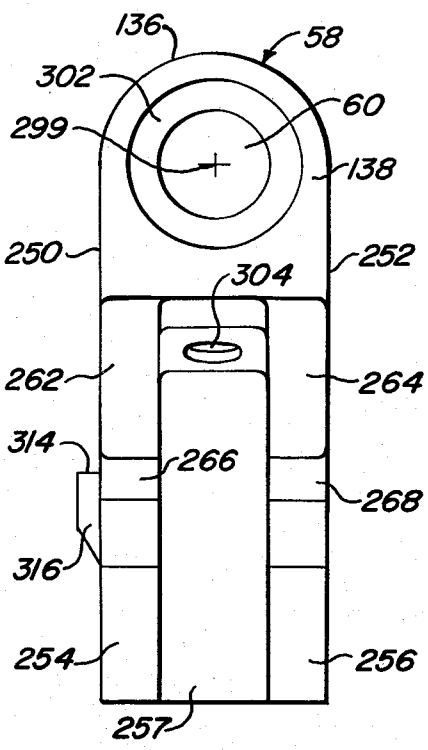
FIG. 15 is an enlarged end view of the transfer member of the breech block assembly of the gun.
Figure 16:
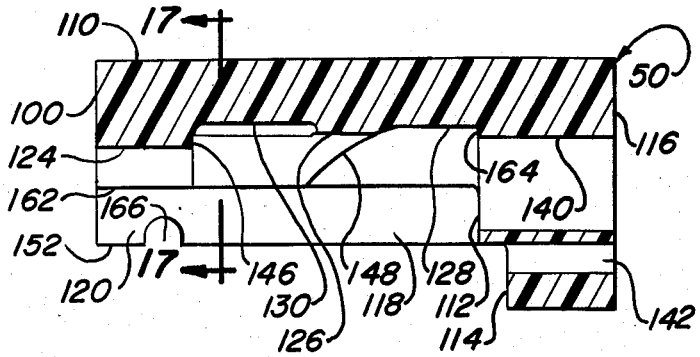
FIG. 16 is an enlarged cross-sectional side elevational view of the main block member of the breech block assembly of the gun.
Figure 17:
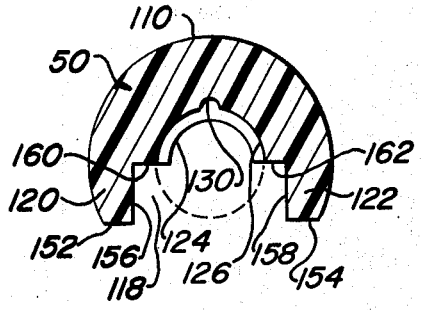
FIG. 17 is a cross-sectional view of the main block member of the breech block assembly taken along the line 17—17 in FIG. 16.
Figure 18:
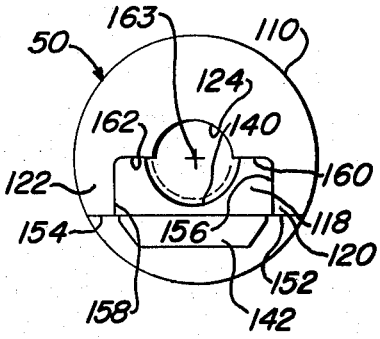
FIG. 18 is an end view of the main block member of the breech block assembly of FIG. 16.
Figure 19:
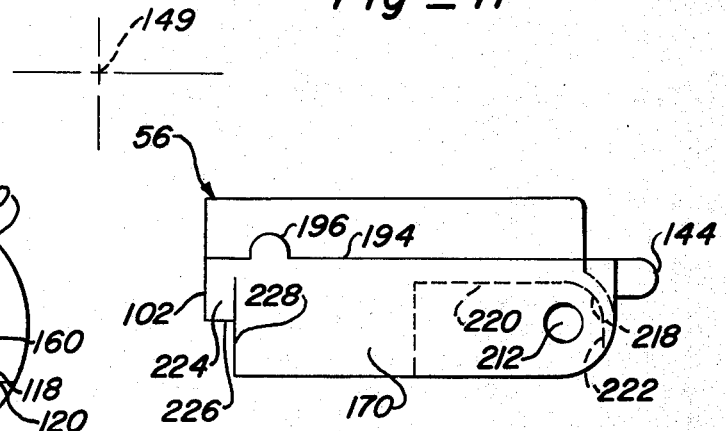
FIG. 19 is an enlarged side elevational view of the lower support block member of the breech block assembly of the gun.
Figure 20:
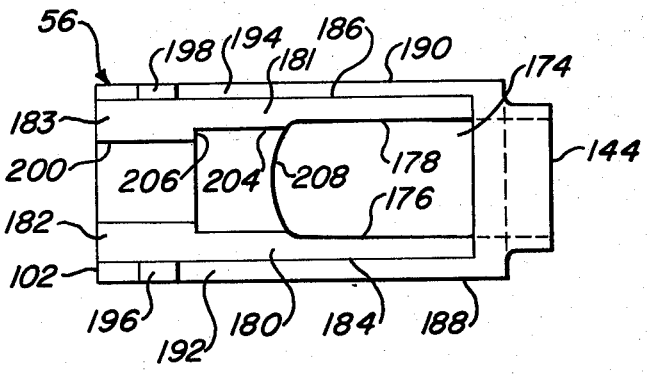
FIG. 20 is a top view of the support block member of the breech block assembly of the gun shown in FIG. 19.
Figure 21:
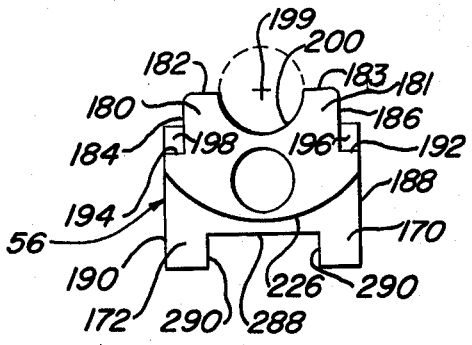
FIG. 21 is an end view of the lower support block member of the breech block assembly of the gun shown in FIG. 19.
Figure 22:
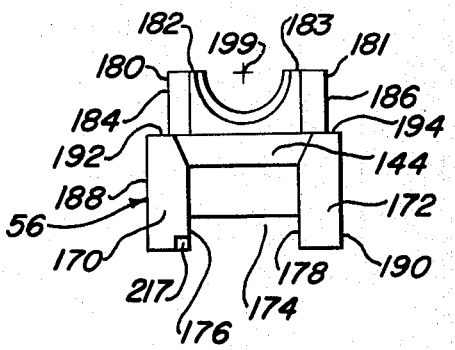
FIG. 22 is another end view of the lower support block member of the breech block assembly of the gun shown in FIG. 19.
Figure 23:
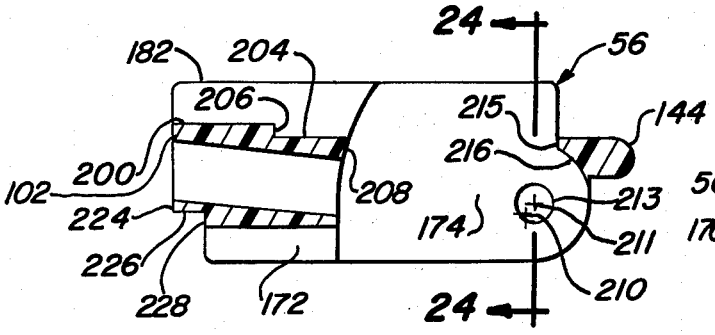
FIG. 23 is a cross-sectional side elevational view of the lower support block member of the breech block assembly of the gun of FIG. 21.

Referring now to FIGS. 11, 16–18, the body member 50 is made of one piece of molded plastic material, Noryl being presently preferred, and has a generally cylindrical outer peripheral surface 110 having a diameter approximately equal to the inside diameter of housing portion 72 so as to be slidably closely supported therewith. The front lower portion of member 50 is slotted between front end surface 100 and axially offset intermediate transverse surfaces 112, 114. The outer peripheral surface, between surfaces 100 and 114, extends circumferentially approximately 270° and, between surfaces 114 and rear end surface 116, extends 360°. As shown in FIGS. 16–18, a generally rectangular axially extending downwardly opening slot 118 is provided between axially extending transversely spaced parallel downwardly extending flange portions 120, 122. A series of coaxial axially extending semi-cylindrical surfaces 124, 126, 128 of progressively larger diameter extend along the upper portion of slot 118. An axially extending key slot 130 of generally rectangular longitudinal cross-section is provided in the upper front portion of surface 126. The diameter of surface 124 is approximately equal to the outside diameter of the cylindrical outer peripheral surface 132 of barrel 32 which is slidably closely supported thereon. The diameter of surface 126 is approximately equal to the diameter of the cylindrical outer peripheral surface 134 of member 52 which is closely supported thereon. The diameter of surface 128 is slightly larger than the diameter of the semi-cylindrical upper outer surface 136 of the upper portion 138 of member 58, FIGS. 14–15. A cylindrical bore 140 coaxial with surfaces 124, 126, 128 extends from the rear surface 112 of slot 118 to the rear end surface 116. An axially extending slot 142 of generally trapezoidal transverse cross-section extends between surfaces 114 and 116 and telescopically receives and supports a similarly shaped rearwardly extending flange portion 144 of member 56.

Body member 50 further comprises a transverse shoulder 146 between bore portions 124, 126 and an upwardly rearwardly radially curved shoulder 148 between bore portions 126, 128 having a center of curvature located at 149, FIG. 16, and generally corresponding to the curvature of the curved upper front surface 150 of member 58 which is matingly positioned adjacent thereto in the closed firing position. Flange portions 120, 122 terminate in spaced axially extending transverse coplanar abutment surfaces 152, 154. Slot 118 is further defined by a pair of spaced axially extending parallel side wall surfaces 156, 158, a pair of coplanar spaced axially extending downwardly facing upper wall surfaces 160, 162, which are coplanar with the central axis 163 of the central bore portions 124, 126, 128, 140, and end wall portion 112 providing a transverse shoulder surface 164 above bore 140. A semi-cylindrical locating notch 166 is provided in each of the surfaces 152, 154.

Member 50 is adapted to be matingly received on and supported at the lower front end by member 56 which is also made of one piece of molded plastic material, Lexan being presently preferred. As shown in FIGS. 18–24, member 56 comprises a pair of spaced parallel downwardly extending side flange portions 170, 172 which define an intermediate cavity 174 for slidably receiving member 58 with spaced parallel side surfaces 176, 178, FIG. 24, providing a guideway therefor. A pair of axially extending spaced parallel upwardly extending side flange portions 180, 181 have coplanar upwardly facing abutment surfaces 182, 183, outer parallel side surfaces 184, 186 inwardly offset from outer parallel side surfaces 188, 190 of flange portions 170, 172 to provide coplanar axially extending upwardly facing abutment surfaces 192, 194 including rounded upwardly extending locating lug portions 196, 198 adapted to matingly abuttingly receive the abutment surfaces 152, 154 and notches 166 of member 50. A semi-cylindrical stepped upwardly facing axially extending bore, having a central longitudinal axis 199 coplanar with surfaces 182, 183, is provided between flange portions 180, 181 by a first bore portion 200 having a diameter and axial length corresponding to bore portion 124 of member 50, and a second enlarged bore portion 204 connected to bore portion 200 by a radially extending abutment shoulder 206 and having a diameter generally corresponding to bore portion 126 of member 50. An upwardly rearwardly radially curved transverse surface 208, FIG. 23, intersects bore portion 204 and side wall surfaces 176, 178 with a center of curvature located at 210, FIG. 23, in downwardly forwardly offset relationship to the axis 211 of coaxial pivot pin holes 212, 213 in flange portions 170, 172. The length of the radius of curvature of surface 208 is located radially from surfaces 182, 183 the same distance as the center of curvature 149 of surface 148 is located from surfaces 160, 162 while being located from front end surface 102 of member 56 a slightly lesser distance (e.g., 0.010 inch) than the center of curvature 149 of surface 148 is located from front end surface 100 of member 50 for a purpose to be hereinafter described.

Figure 24:
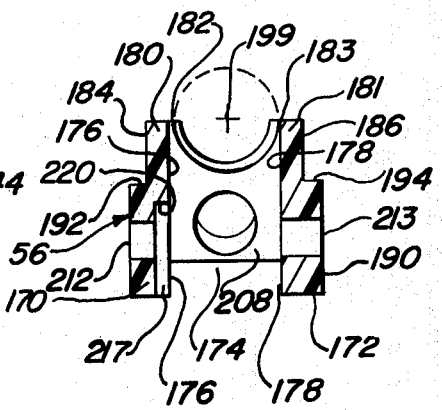
FIG. 24 is a cross-sectional view of the lower support block member of the breech block assembly of the gun taken along the line 24—24 in FIG. 19.

Transverse locating lug 144 is of generally trapezoidal cross-section, and corresponding in size to the slot 140 of member 50 so as to be slidably received therewithin. Lug 144 extends rearwardly between flange portions 170, 172 while integrally connecting the flange portions 170, 172 and 180, 181. Lug 144 includes a forwardly facing transverse side surface 215 and a downwardly forwardly facing curved side surface 216, FIG. 23, which, along with side surfaces 176, 178, 208, define the cavity 174 in which member 58 is pivotally mounted in the assembled position. A torsion spring slot 217, FIG. 24, is provided in flange portion 170 with a curved abutment surface 218, coaxial with hole 212, connecting downwardly and forwardly facing abutment surfaces 220, 222, FIG. 19.

Figure 11:
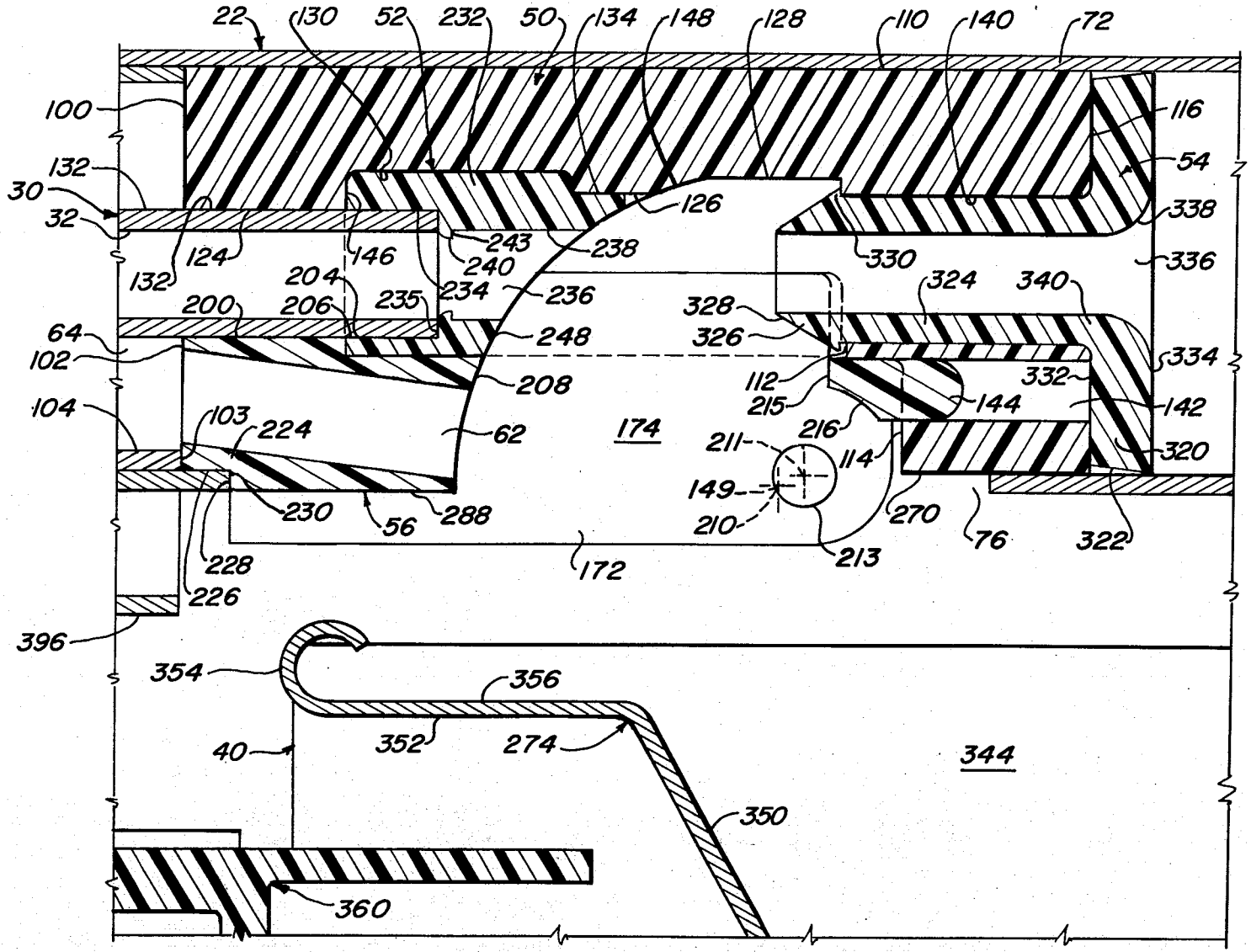
FIG. 11 is an enlarged cross-sectional side elevational view of the breech block assembly portion of the gun with parts removed.

The front end of member 56 is provided with a forwardly extending abutment portion 224 having a partial cylindrical abutment surface 226, of a diameter substantially equal to the inside diameter of tubular housing portion 72 so as to be slidably seated therewithin, and a transverse annular abutment surface 228 adapted to be seated against transverse annular abutment surface 230 on housing portion 72 at the front end of slot 76, as shown in FIGS. 1 and 11, with flange portions 170, 172 extending downwardly through slot 76 which is of generally corresponding configuration.

In the assembled position, the downwardly facing abutment surfaces 152, 154 and 160, 162 of member 50 are seated on upwardly facing abutment surfaces 192, 194 and 182, 183, respectively, of member 56 with notches 166 of member 50 receiving lugs 196, 198 of member 56. The surfaces 124, 200 of members 50, 56, respectively, are seated against the outer cylindrical surface 132 of barrel 30.

Figure 12:
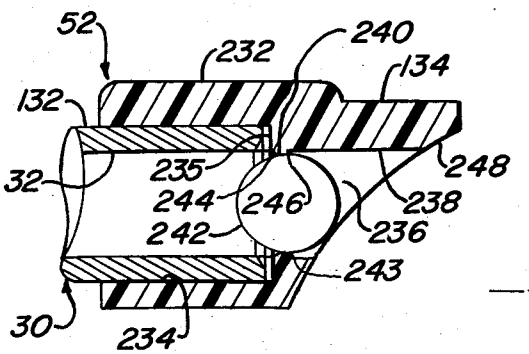
FIG. 12 is an enlarged cross-sectional side elevational view of a portion of the breech block assembly of the gun with parts removed.
Figure 13:
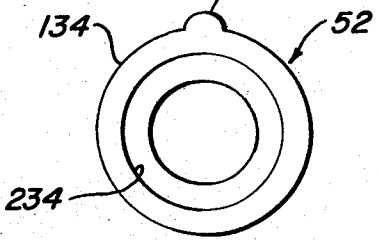
FIG. 13 is an enlarged end view of the firing chamber member of the breech block assembly of the gun.

Referring now to FIGS. 11–13, connecting member 52 is made of one piece of molded plastic material, Du Pont Hytrel 5555 being presently preferred. Member 52 is of elongated generally cylindrical cross section providing an outer cylindrical support surface 134 having a diameter corresponding to the diameter of semi-cylindrical surfaces 126 and 204 of members 50 and 56, respectively, which enclose member 52 in the assembled position with elongated rib portion 232 received in slot 130 to fixedly locate the member 52 therebetween. As shown in detail in FIG. 12, member 52 comprises a counterbore 234 defining an annular abutment shoulder 235 and having a diameter approximately equal to the diameter of the outer peripheral surface 132 of barrel 30, the rear end of which extends therewithin in close fitting engagement therewith. In the illustrative arrangement, the rear end of barrel 30 is spaced forwardly of shoulder 235, as illustrated in FIG. 12, to provide assembly clearance, but may preferably abut the shoulder 235, as shown in FIG. 11, and has a tapered counterbore facilitating entry of a projectile. A firing chamber 236 is provided at the rear end of member 52 by a cylindrical bore 238 coaxial with counterbore 234 and connected thereto by an annular radially inwardly extending projectile holding rib 240 of slightly smaller diameter which is adapted to hold a B-B type steel projectile 242 having a nominal diameter of 0.175 inch, in a final firing position as illustrated. In the illustrative embodiment, the nominal diameter of barrel bore 32 is 0.177 inch, the nominal inside diameter of rib 240 is 0.171 inch, and the nominal diameter of bore 238 is 0.179 inch. The rib 240 has a transverse radially extending rear side surface 243 which intersects a rounded front surface 244 at approximately 90° to provide a sharp annular edge 246 to engage the projectile in the firing position. The edge of the rib holds the projectile in firing position and seals the firing chamber relative to bore 32. The plastic material of member 52 and the structural arrangement are such that the edge portion 246 of rib 240 is subject to resilient deformation to permit the projectile to pass by the rib into the barrel bore when sufficient force is exerted on the projectile by compressed air in the firing chamber. The rounded front surface 244 facilitates movement of the projectile into the barrel bore 32. A projectile is releasably held by the rib 240 during firing of the gun until a predetermined minimum shot start force, exerted by compressed air behind the projectile, has been exceeded whereupon the projectile will move past rib 240 by deformation and/or resilient compression of the relatively narrow rib.

An upwardly rearwardly curved abutment surface 248 is provided at the rear of member 52 to intersect the bore portion 238 with a radius of curvature which is generally concentric with the radii of curvature of surfaces 148, 208 of member 52 but which is of slightly less length (e.g., 0.010 inch) than the radius of curvature of surfaces 148, 208, respectively, and, in addition, the center of curvature 249 is located the same radial distance from the center line of the bores 234, 238 as the centers of curvature of surfaces 148, 208 but is located a greater axial distance (e.g., 0.015 inch) from front surfaces 100, 102 than the center of curvature 210 of surface 208, for a purpose to be hereinafter described. Thus, in the assembled position of FIG. 11, the curved surface 248 of member 52 is axially rearwardly located and extends slightly beyond the curved surfaces 148, 208 of members 50, 56.

Figure 4:
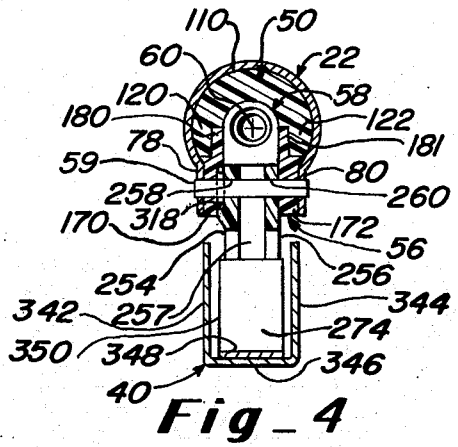
FIG. 4 is a cross-sectional view of the gun, with parts removed, taken along the line 4—4 in FIG. 1*a;*
Figure 14:
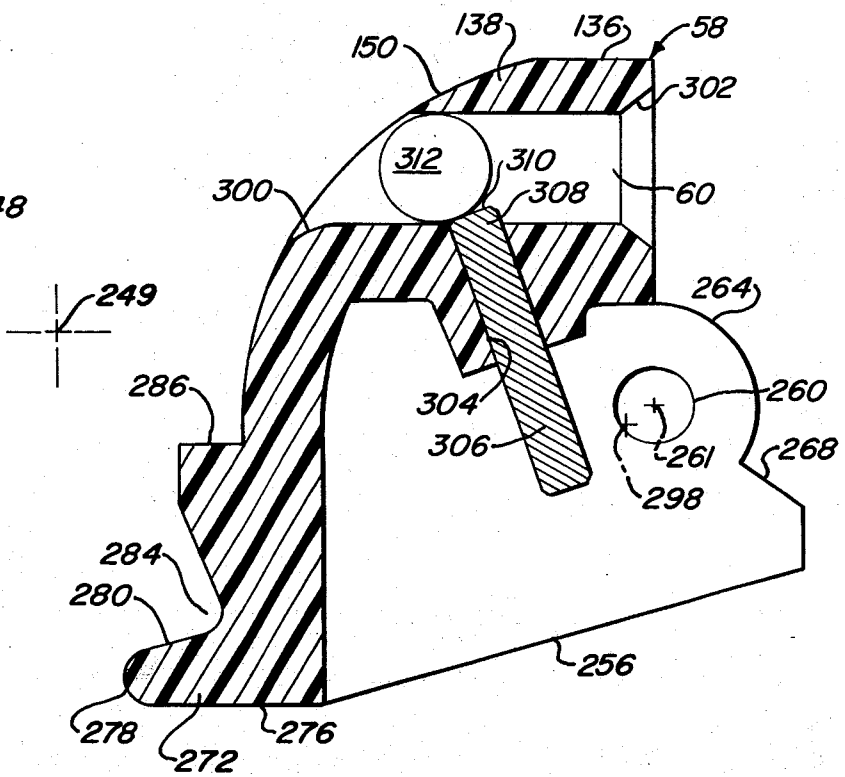
FIG. 14 is an enlarged cross-sectional side elevational view of the transfer member of the breech block assembly of the gun.

Referring now to FIGS. 4, 14 and 15, member 58 comprises a pair of spaced parallel side surfaces 250, 252 having a width slightly less (e.g., 0.005 inch) than the width of surfaces 176, 178 of member 56 so as to be freely slidably guidable rotatably received therebetween and substantially less (e.g., 0.161 inch) than the width of surfaces 156, 158 of member 50 so as to be freely movable therebetween. A pair of spaced parallel side wall portions 254, 256 defined a downwardly and rearwardly opening central slot 257 therebetween. A pair of coaxial transverse pin holes 258, 260 having a central axis 261 are provided in wall portions 254, 256 to receive pivot pin 59, FIG. 4, supported in aligned holes 212, 213 of member 56 and in aligned pivot pin holes in flange portions 78, 80 of housing 22 to thereby pivotally support member 58 for pivotal swinging movement between an upwardly displaced firing position and a downwardly displaced loading position. Rounded shoulder portions 262, 264, having a radius of curvature coaxial with holes 258, 260 are provided on the rear side surfaces of side wall portions 254, 256 to provide clearance for the swinging pivotal movement of member 58 relative to members 50, 56. Downwardly and rearwardly inclined abutment surfaces 266, 268 extend radially relative to the central axis of holes 258, 260 to provide locating stop means engageable with the bottom surface of member 56 at 270, FIGS. 1 and 11, in the loading position of member 58.

A forwardly extending shoe portion 272 is provided at the lower front end of member 58 for actuable and clamping engagement with a clip member 274, FIG. 1, carried by the cocking lever 40. The shoe portion has a flat bottom surface 276 adapted to abut a portion of the clip in the firing position, a rounded camming nose portion 278 adapted to cammingly engage a portion of the clip during movement of the cocking lever from the stowed position to the cocking position, and an upper rearwardly inclined surface 280 adapted to engage the clip member 274 at 282 in the firing position. A clearance space 284 is provided above the shoe portion to permit engagement and disengagement from the clip element. A flat transverse abutment surface 286 is located to abut the flat transverse abutment surface 288, FIG. 11, of member 56 in the closed firing position.

The forwardly upwardly facing curved surface 150 of member 58, which has a radius of curvature generally coaxial with the radii of curvature of surfaces 148 of member 50, 208 of member 56, and 248 of member 52, extends upwardly and rearwardly from abutment surface 286 to axially extending upper surface 136. The center 298 of the radius of curvature of surface 150 is located in forwardly downwardly offset relationship to the axis 261 of holes 258, 260, while being spaced from the central axis 299 of bore 60 the same distance as the centers of surfaces 148, 208, 248 are spaced from central axes 163, 199, 249 but spaced from abutment surface 103 the same distance as center of curvature 210 of member 56 and slightly less (e.g., 0.015 inch) than the distance of center of curvature 249 of member 52. The length of the radius of curvature of surface 150 is slightly less (e.g., 0.005 inch) than the radius of curvature of surfaces 208 of member 56 and 148 of member 50 so as to be freely pivotally movable relative thereto but is slightly greater (e.g., 0.005 inch) than the radius of curvature of surface 248 of member 52 so as to have a sliding interference fit therewith for the purpose of establishing air sealing engagement therebetween in the firing position.

Figure 25:
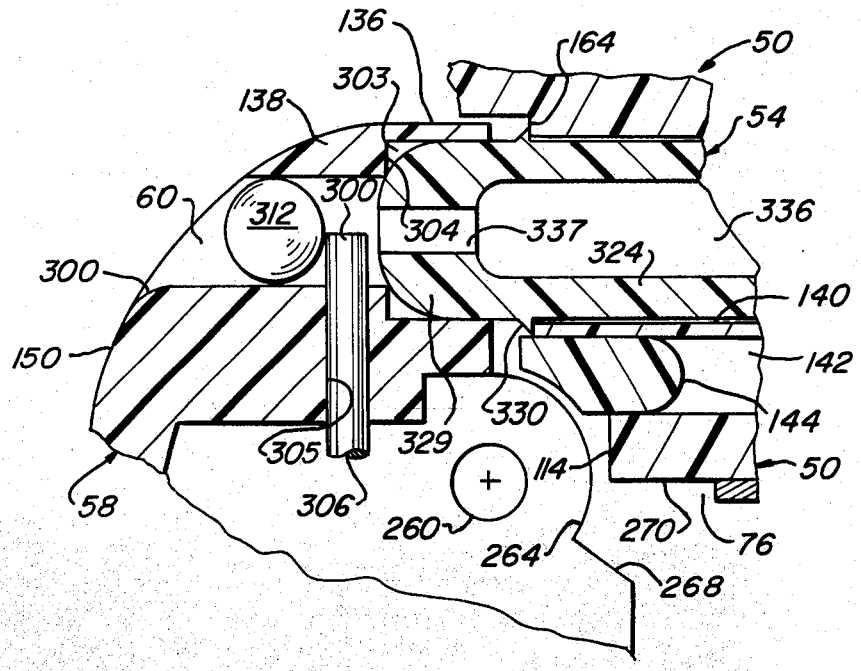
FIG. 25 is an enlarged partial side elevational view in cross-section of an alternative for a portion of the breech block assembly.

The cylindrical projectile holding chamber 60 is provided in the upper portion 138 of member 58 so as to be substantially coaxial with the barrel bore 32 and bore portion 238 of member 52 in the firing position. The front end of chamber 60 opens through curved surface 150 and has a slightly rounded lower edge 300 to facilitate projectile loading. The rear end of chamber 60 is provided with a sealing chamber which may take the form of a conical beveled enlarged abutment surface 302 as shown in FIG. 14, or an elongated cylindrical chamber 303 as shown in FIG. 25 terminating in a transverse surface 304 for the purpose of establishing sealing abutting engagement with the forward end of sealing sleeve 54 in the closed firing position. An upwardly forwardly inclined pin hole 305 centrally intersects the chamber 60 and fixedly supports a magnetic pin 306 having the upper end 308 located in chamber 60 with the end surface 310 upwardly rearwardly inclined to extend substantially tangentially to the peripheral surface of a projectile 312 whereby a projectile is held in the projectile chamber during movement of member 58 from the open loading position to the closed firing position and held in the firing position until moved forwardly into bore portion 238 of member 52, FIG. 12, against shot start rib 240 during the initial portion of the air compression stroke when the gun is fired. The pin hole 305 and pin 306 may be alternatively mounted in a position transverse to the axis of chamber 60, as shown in FIG. 25, or in any other suitable position.

An upwardly facing elongated torsion spring abutment surface 314 is provided on a laterally outwardly protruding ledge 316 on side surface 250 and is located in the spring slot 217 (FIG. 24) in member 56 in downwardly spaced relationship to surface 220 to confine a torsion spring 318, FIG. 4, mounted thereon about pin 59 so that the member 58 is spring biased toward the open loading position.

Referring now to FIG. 11, the sealing sleeve member 54 comprises a radially extending rear flange portion 320, having a forwardly inwardly inclined generally cylindrical peripheral surface 322 to facilitate assembly, and an elongated tubular sleeve portion 324 having an abutment lip portion 326 at the forward end thereof. The abutment lip portion 326 may take the form of a conically tapered peripheral end surface 328, as shown in FIG. 11, adapted to flexibly sealably seat on conical surface 303 of member 58 in the closed firing position, or, as a slightly modified embodiment a protruding cylindrical head portion 329, as shown in FIG. 25, without change in other structure except for the angle of magnet 306, adapted to be sealingly received in a correspondingly shaped chamber 303 in member 58, the length of sleeve portion 324 being such as to insure an interference fit between end surfaces 302, 328 in the closed firing position resulting in some slideably rearward resilient displacement of the lip portion 320. A radially outwardly extending annular sealing shoulder 330 has a diameter larger than bore portion 140 of member 50 so as to sealably engage shoulder surfaces 112, 164 of member 50 in the assembled position. The outer diameter of sleeve portion 324 is slightly less, e.g. 0.040 inch, than the diameter of bore portion 140 so as to be freely slidable therewithin. Member 54 is assembled by sliding the sleeve portion 322 forwardly through bore portion 140 with lip portion 330 being resiliently compressed therewithin until passing beyond shoulder 112 whereupon to resiliently expand to lock the member 54 in assembled position with the front side surface 332 of flange portion 320 sealingly abutting the rear side surface 116 of member 50 and the outer peripheral surface 322 sealingly abutting the inner peripheral surface of the tubular housing member 22. The flange portion 320 also serves the function of a resilient cushion between member 50 and the piston assembly 34 which abuts the rear side flange surface 334 in the fully extended firing position of FIG. 1. A central axially extending bore 336 provides an air passage connecting the air compression chamber 26 to the projectile holding chamber 60 in the member 58. In the presently preferred embodiment of FIG. 25, a reduced diameter air passage 337 connects bore 336 to chamber 60 to restrict air flow from the compression chamber resulting in cushioning of the piston assembly at the end of the compression stroke while also reducing the recoil effect thereby increasing the life of the parts and the accuracy of the user of the gun. The arrangement is such as to provide a completely sealed air passage with increases in air pressure increasing all sealing engagements between the member 54 and the parts in sealing contact therewith. The flange portion of bore 336 is connected to the sleeve portion by a large radius outwardly flared bore portion 338 to provide sufficient flexibility in connecting portion 340 to enable elongation of the sleeve portion 322 relative to the flange portion 320.

Figure 2:
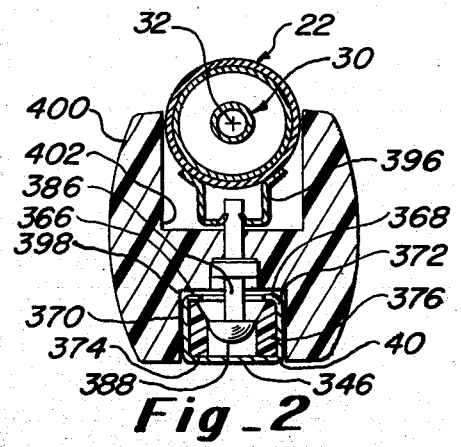
FIG. 2 is a cross-sectional view of the gun taken along the line 2—2 in FIG. 1*a;*

The cocking lever 40 has a general U shaped cross section defined by spaced parallel axially extending side flange portions 342, 344 connected by a transverse web portion 346, FIGS. 2–4. As shown in FIGS. 1a and 11, clip member 274 comprises a lower base flange portion 348 fixed on web portion 346 of cocking lever 40, an upwardly forwardly extending intermediate portion 350, and a flat axially extending upper portion 352 having a reversely bent terminal portion 354. The arrangement is such that the upper surface 356 of clip portion 352 abuts the bottom surface 276 of member 58 in the closed stowed position of the cocking lever and exerts an upwardly directed force on the member 58 to positively hold the member in the closed firing position against the bias of spring 318, FIG. 4.

The cocking lever is latched in the closed stowed position by an elongated manually operable slide bar 360 slidably mounted on the upper surface 362 of a forwardly extending portion 364 of cocking lever web portion 346 in a trackway provided by inwardly turned transverse flange means 366, 368 integrally formed on reduced width portions 370, 372 of side flange portions 342, 344 as shown in FIGS. 1a, 2 and 3. The slide bar 360 comprises spaced parallel side flange portions 374, 376, an upper connecting web portion 378, a transverse front flange portion 380, and a transverse rear flange portion 382. An elongated notch 384 in the upper wall 378 of the slide bar receives a latch pin 386 having an enlarged rounded head portion 388 adapted to engage a downwardly facing abutment surface 390 on the latch bar in a forwardly displaced latching position to which the latch bar is biased by a compression spring 392 mounted under a rearwardly protruding portion 394 of web portion 378 in abutting engagement with flange portion 382 and flange portion 350 of clip member 274.

As shown in FIG. 2, the pin 386 is fixedly mounted on a bracket 396 fixed to the housing 22. In the stowed position, the cocking lever assembly is mounted in an elongated downwardly opening slot 398 in a forearm housing 400 which also has an elongated upwardly opening slot 402 receiving the front portions of housing 22. The front end of the housing 400 has an upwardly outwardly extending access slot 404, FIG. 1a, to enable the gun operator to reach the forward end of slide bar 360 to manually push the slide bar rearwardly to disengage the pin head 388 from surface 390, such movement being facilitated by a pin 406 and a slot 408 connection between the latch bar and the cocking lever.

In operation, in order to cock and load the gun, the latch bar 360 is pushed rearwardly to clear the head portion 388 of latch pin 396 whereupon the force of the spring associated with the lever will be effective to slightly downwardly pivot the cocking lever 40 so that the latch pin head will be located above the latch surface 390 and free the cocking lever for a cocking cycle. The cocking lever 40 is manually grasped at the forwardmost end and pivoted downwardly rearwardly about pivot pin 42 toward an open extended cocking position (not shown). During the initial portion of the cocking lever movement, the reversely curved terminal portion 354 of the clip 274 will engage the inclined upper surface 280 of the shoe portion 272 of member 58 to free the member 58 from the sealing engagements effected in the closed firing position, whereafter the torsion spring 318 association with the member 58 will be effective to move the member 58 to a fully open loading position (not shown) whereat abutment surfaces 268, 270 stop the member 58 in the loading position with projectile holding chamber 60 axially aligned with the inclined loading port 62 in member 56 which has an open connection to the projectile storage chamber 64 so as to receive a projectile therein as the gun is turned toward a vertical position as is the normal procedure during cocking. When the projectile holding chamber 60 becomes aligned with the loading port 62, a projectile will move into the projectile holding chamber into holding engagement with the magnetic pin 306 which is spaced from the front end of the chamber 60 a distance such as to accommodate only one projectile at a time thereby eliminating the possibility of jamming the apparatus. The member 58 remains in the open loading position throughout the remainder of the cocking cycle whereby the piston assembly 34 is moved rearwardly by engagement of rounded lug 410 on lever 44 with a notch 412 in piston rod 36 until the sear 46 latchingly engages an inclined plate 414 on the rear end of the piston rod to prepare the gun for the next firing cycle. As the gun is cocked, a trigger safety 416 is moved to a safe position by abutting engagement with flange portion 418 of lever 44 to preclude accidental firing of the gun during return of the cocking lever to the closed stowed position. Rearward movement of the piston assembly and downward movement of member 58 allows air to enter the compression chamber through passage 336 in member 54.

As the cocking lever approaches the stowed firing position during return movement by manually applied pivotal forces, the rounded nose portion 278 of member 58 is engaged by the upper surface 356 of the clip member 274 to initiate return pivotal movement of the member 58 toward the closed firing position. Thereafter, the flat bottom surface 276 of the nose portion 272 is gradually brought into full abutting engagement with the upper surface 356 of the clip member 274 to initiate return pivotal movement of the member 58 toward the closed firing position. Thereafter, the flat bottom surface 276 of the nose portion 272 is gradually brought into full abutting engagement with the upper surface 256 of the clip member 274 as member 58 is moved further upwardly toward the firing position. As member 58 is moved toward the firing position, the upper portion of curved surface 150 on member 58 is moved along and in spaced relationship to curved surface 208 on member 56 and then engages the curved surface 248 of member 52. At the end of the movement, the conical surface 302 on member 58 engages the conical surface 328 on the end of the sealing sleeve portion 322 and slightly radially and rearwardly resiliently compresses the sealing sleeve portion whereby air tight sealing engagement is effected between the curved surfaces 248, 150 and between the conical surfaces 302 (FIG. 14), 328 (FIG. 11). At the end of the return movement of the cocking lever, the latch bar 360 is cammed rearwardly by engagement of inclined surface 420 with the rounded portion 388 of latch pin 386 against the bias of the compression spring 392 which thereafter moves the latch bar forwardly into latching engagement with the latch pin as soon as the cocking lever reaches the fully closed stowed firing position.

When the gun is fired by pulling the trigger assembly 47 rearwardly after safety 416 has been manually moved forwardly, the sear 46 is released from restraining engagement with plate 414 on the rear end of the piston rod 36 and the piston assembly 34 is driven forwardly by the compression spring 38. As soon as the air pressure in front of the piston assembly in chamber 26 is sufficiently increased to overcome the holding effect of the magnetic pin 306, the projectile 312 in chamber 60 is moved forwardly at the beginning of the stroke into the rear bore portion 238 (FIG. 12) of the connecting member 52 into holding sealing engagement with the shot start holding rib 240. When the air pressure has increased sufficiently to overcome the frictional holding effect of the shot start rib 240, the projectile 242 is forced past the rib and driven forwardly into and through the barrel bore 32 at a relatively high uniform velocity. At the end of the compression stroke, the piston assembly 34 abuts the rear surface 334 of the flange portion 320 of the sealing member 54 and is cushioned thereby.

Since the inventive concepts hereinbefore disclosed by reference to illustrative and presently preferred embodiments thereof may be otherwise utilized in alternative embodiments thereof, it is intended that the appended claims be construed to cover alternative forms of the inventive concepts except insofar as limited by the prior art.

I claim:

1. An air gun or the like for propelling a projectile by compressed air or the like and comprising:

a source of compressed air for propelling a projectile from the gun;

barrel means for guiding the projectile from the gun;

firing chamber means between said source of compressed air and said barrel means for holding a projectile in a firing position;

first passage means for connecting said firing chamber means to said barrel means and for guiding a projectile from said firing chamber means to said barrel means;

trigger means for initiating a firing cycle during which compressed air is delivered to said firing chamber means from said source of compressed air to propel a projectile from the gun through said barrel means;

projectile holding means for receiving a projectile to be fired from the gun and for holding the projectile in axially spaced relationship to said firing chamber means until the firing cycle is initiated by actuation of said trigger means;

second passage means for connecting said projectile holding means to said firing chamber means and for enabling movement of the projectile from the projectile holding means to the firing chamber means during an initial portion of the firing cycle; and sealing and retention means in said firing chamber means for engaging the projectile and holding the projectile in the firing chamber and sealing said first passage means relative to said firing chamber means during an intermediate portion of the firing cycle and for releasing the projectile for movement into said first passage means during a terminal portion of the firing cycle.

2. An air gun or the like for propelling a projectile from the gun by compressed air or the like and comprising:

a source of compressed air for propelling a projectile from the gun;

barrel means for guiding the projectile from the gun;

firing chamber means between said source of compressed air and said barrel means for holding a projectile in a firing position;

first passage means between said firing chamber means and said barrel means for connecting said firing chamber means to said barrel means to enable movement of a projectile from said firing chamber means to said barrel means;

trigger means for initiating a firing cycle during which compressed air is delivered from said source of compressed air to said firing chamber means to propel a projectile from the gun through said barrel means;

movable projectile transfer means between said firing chamber means and said source of compressed air for transferring a projectile from a projectile loading position to a projectile firing position;

projectile holding chamber means in said movable projectile transfer means for holding a projectile during transfer from the projectile loading position to the projectile firing position;

second passage means for connecting said source of compressed air to said projectile holding chamber means to deliver compressed air to said projectile holding chamber means from said source of compressed air;

third passage means for connecting said projectile holding chamber means and said source of compressed air to said firing chamber means to enable movement of a projectile in said projectile holding chamber means to said firing chamber means during an initial portion of the firing cycle and to enable passage of compressed air to said firing chamber means from said source of compressed air through said projectile holding chamber means to propel the projectile from the gun;

first sealing means for sealing said second passage means relative to said projectile holding chamber means in the firing position to substantially confine flow of compressed air during the firing cycle from said source of compressed air to said projectile holding chamber means;

second sealing means for sealing said third passage means relative to said projectile holding chamber means and said firing chamber means in the firing position to substantially confine flow of compressed air during the firing cycle from said source of compressed air to said firing chamber means;

projectile holding means for holding a projectile in said projectile chamber firing means in the firing position until the firing cycle is initiated and for releasing the projectile during an initial portion of the firing cycle to enable the projectile to be moved from said projectile holding chamber means through said third passage means to said firing chamber means during the initial portion of the firing cycle; and sealing and projectile retention means in said firing chamber means for engaging a projectile and holding the projectile in said firing chamber means and for sealing said first passage means relative to said firing chamber means during an intermediate portion of the firing cycle and for releasing the projectile for movement into said barrel means through said first passage means during a terminal portion of the firing cycle.

3. An air gun or the like for propelling a projectile from the gun by compressed air or the like and comprising:

a source of compressed air in the gun for propelling a projectile from the gun;

barrel means on the gun for guiding a projectile from the gun;

firing mechanism means in said gun for actuation to cause a firing cycle during which a projectile is propelled from the gun;

trigger means on the gun for initiating a firing cycle during which compressed air is delivered from said source of compressed air to propel a projectile from the gun through said barrel means;

movable cocking lever means on the gun for actuating said firing mechanism means during a cocking cycle to prepare the gun for the firing cycle;

movable projectile transfer for moving a projectile from a storage position to a firing position during the cocking cycle; and cam means on said projectile transfer means for engagement with said cocking lever means during the cocking cycle to move said projectile transfer means from the storage position to the firing position and for forcibly holding said projectile transfer means in the firing position.

4. An air gun or the like for propelling a projectile from the gun by compressed air or the like and comprising:

tubular housing means for supporting mechanism of the gun;

barrel means for guiding a projectile from the gun mounted at the forward end of said tubular housing means;

a source of compressed air for propelling a projectile from the gun mounted at the rearward end of said tubular housing means;

movable projectile transfer means for transferring a projectile from a loading position to a firing position in axial alignment with said barrel means;

projectile holding chamber means in said movable projectile transfer for holding a projectile during movement of said movable projectile transfer means from the loading position to the firing position and for connecting said source of compressed air to said barrel means;

breech block assembly means for connecting said source of compressed air to said barrel means mounted between said source of compressed air and said barrel means; said breech block assembly means comprising:

a plurality of abuttingly engaged block members mounted in assembled relationship in said tubular housing means;

abutment surfaces on said block members supporting said block members in assembled position in said tubular housing means;

first passage means for connecting said source of compressed air to said barrel means defined by axially and radially adjacent surfaces of said block members and extending axially between said barrel means and said source of compressed air;

a projectile transfer slot for movably receiving said movable projectile transfer defined by axially and radially adjacent surfaces of said block members and intersecting said first passage means and extending radially outwardly therefrom through said tubular housing means;

firing chamber means for receiving a projectile transfer means and for holding a projectile in axial alignment with said barrel means and defined by at least one of said block members and being located between said barrel means and said projectile transfer slot;

a rearwardly facing front side surface of said projectile transfer slot being defined by said block members and extending from a position adjacent said tubular housing means to a position beyond said firing chamber means; and said projectile transfer means having a forwardly facing front side surface correspondingly configured to said rearwardly facing front side surface of said projectile transfer slot and being supported in closely spaced relationship relative thereto, said projectile transfer means being positioned and located in said projectile transfer slot so that portions of said forwardly facing side surface of said projectile transfer means and portions of said rearwardly facing side surface of said projectile transfer slot about said firing chamber means and said projectile holding chamber means are abuttingly frictionally sealingly engaged in the firing position.

5. The invention as defined in claim 4 wherein said rearwardly facing front side surface of said projectile transfer slot and said forwardly facing front side surface of said projectile transfer means are curved surfaces extending radially inwardly and axially rearwardly relative to said tubular housing means.

6. The invention as defined in claim 5 wherein said projectile transfer means are pivotally mounted relative to said tubular housing means.

7. The invention as defined in claim 6 and further comprising:

pivot pin means for pivotally supporting said projectile transfer means and providing a pivotal axis located radially outwardly from said passage means and axially rearwardly of said rearwardly facing front side surface of said projectile slot;

said rearwardly facing front side surface of said projectile slot and said forwardly facing front side surface of said projectile transfer means are radially formed curved surfaces having centers of curvature located adjacent and in offset relationship to said pivotal axis of said pivot pin means.

8. The invention as defined in claim 7 and further comprising:

sealing means for effecting sealing of said projectile holding chamber means relative to said source of compressed air in the firing position.

9. The invention as defined in claim 8 and further comprising:

operating mechanism means for selective actuation to cause delivery of compressed air from said source of compressed air to said firing chamber means during a firing cycle;

cocking lever means for actuating said operating mechanism means during a cocking cycle to position said operating mechanism means for the firing cycle, said cocking lever means being movable between a stowed position and an extended position during the cocking cycle; and cam means for operatively connecting said projectile transfer means to said cocking lever means to move said projectile transfer means from the loading position to the firing position during the cocking cycle.

10. The invention as defined in claim 9 and further comprising:

spring means operatively associated with said projectile transfer means for moving said projectile transfer means from the firing position to the loading position during the cocking cycle.

11. The invention as defined in claim 10 and further comprising:

latch means for holding said cocking lever means in the stowed position to positively hold said projectile transfer means in the firing position against the bias of said spring means.

12. The invention as defined in claim 11 and wherein:

said sealing means being axially compressible and being axially compressed by said projectile transfer means in the firing position to effect sealing engagement between said projectile transfer means and said sealing means.

13. The invention as defined in claim 12 and wherein said sealing means comprising:

an elongated tubular sleeve portion extending between said projectile transfer slot and said source of compressed air and having an air passage connecting said source of compressed air to said projectile holding chamber means; and an abutment surface on said sleeve portion extending into said projectile transfer slot for abutting sealing engagement with said projectile transfer means.

14. The invention as defined in claim 13 and wherein said projectile transfer means further comprising:

a rearwardly opening sealing chamber; and said abutment surface on said sleeve portion extending into and having sealing engagement with a portion of the wall of said rearwardly opening sealing chamber in the firing position.

15. The invention as defined in claim 14 and wherein said elongated tubular sleeve portion further comprises:

a portion of said air passage next adjacent said abutment surface being of reduced cross-sectional area relative to a rearwardly adjacent portion of said air passage.

16. The invention as defined in claim 15 and wherein said elongated tubular sleeve portion further comprises:

a forward end portion of cylindrical cross-section located within said projectile transfer slot; and said rearwardly opening sealing chamber having a cylindrical cross-section generally corresponding to the cylindrical cross-section of said forward end portion to slidably sealingly receive said forward end portion in the firing position.

17. The invention as defined in claim 16 and wherein said projectile holding means further comprises:

a magnetic member in said projectile holding chamber means engageable with a projectile in said projectile holding chamber means to magnetically hold a projectile in said projectile holding chamber means during movement from the loading position to the firing position.

18. The invention as defined in claim 17 and wherein said projectile transfer means further comprising:

the size of said projectile holding chamber means and the location of said magnetic member being such as to accommodate only one projectile.

19. The invention as defined in claim 18 and further comprising:

a projectile storage chamber in said gun for storing a plurality of projectiles;

a projectile passage connecting said projectile storage chamber to said projectile transfer slot through said rearwardly facing side surface;

said projectile holding chamber means being aligned with said projectile passage in the loading position to receive a projectile; and said forwardly facing surface on said projectile transfer means being located in closely spaced relationship to said rearwardly facing side surface of said projectile transfer slot so as to retain the projectiles in said projectile passage except in the loading position.

20. A fluid operable gun for propelling a projectile by use of compressed fluid comprising barrel means for guiding the projectile from the gun;

a source of compressed fluid for propelling the projectile from the gun through said barrel means;

actuable trigger means for controlling said source of compressed fluid to deliver compressed fluid to said barrel means to propel a projectile from the gun;

transfer means for moving a projectile from a loading position to a firing position;

support means in said gun for movably supporting said transfer means for movement between the loading position and the firing position;

first chamber means in said transfer means for receiving a projectile and for connecting said barrel means to said source of compressed fluid;

a first holding means in said first chamber means for holding a projectile in the loading position and the firing position and during movement therebetween and for releasing the projectile in the firing position after actuation of said trigger means under the influence of forces applied to the projectile by the compressed fluid;

second chamber means for receiving a projectile from said first chamber means after actuation of said trigger means to deliver compressed fluid to said barrel means; said second chamber means being located at the rear end of said barrel means in coaxial relationship therewith; and a second holding means in said second chamber means for holding a projectile in said second chamber means with application of predetermined force by the compressed fluid being effective to drive the projectile into said barrel means and thence through said barrel means and from the gun at a predetermined velocity.

21. The invention as defined in claim 20 and further comprising:

first sealing means associated with said second holding means to substantially sealably engage the projectile and substantially prevent passage of compressed fluid into said barrel means until application of said predetermined force.

22. The invention as defined in claim 21 and further comprising:

second sealing means effective between said transfer means and said second chamber means for confining compressed fluid in said first chamber means and said second chamber means in the firing position and until the projectile is driven past said second holding means into said barrel means.

23. The invention as defined in claim 22 and wherein:

said first holding means comprises a magnetic member effective to hold the projectile by magnetic force.

24. The invention as defined in claim 23 and wherein:

said second holding means comprises a deformable annular rim radially inward of the inner wall of said second chamber means and defining a passage of smaller size than the projectile so as to sealably engage the periphery of the projectile until application of the predetermined force and thereafter permit movement of the projectile through said passage.

25. The invention as defined in claim 24 and wherein:

said second chamber means comprising a connecting member mounted between said barrel means and said first chamber means and being made of molded plastic material, an elongated bore in said member of larger diameter than the projectile and adapted to receive the projectile from said first chamber means; and said deformable annular rim comprising an integral portion of said connecting member.

26. The invention as defined in claim 25 and wherein:

said transfer means comprising a transfer member made of molded plastic material; and said second sealing means comprising an abutment surface on said connecting member circumjacent said elongated bore and an abutment surface on said transfer member circumjacent said first chamber means frictionally sealably engageable in the firing position.

27. The invention as defined in claim 26 and further comprising:

third sealing means between said transfer means and said source of compressed fluid for effecting sealing engagement therebetween in the firing position.

* * * * *